US009480113B2

(12) United States Patent
Kim et al.

(10) Patent No.: US 9,480,113 B2
(45) Date of Patent: Oct. 25, 2016

(54) CONTROL CIRCUIT OF LED LIGHTING APPARATUS

(71) Applicant: SILICON WORKS CO., LTD., Daejeon-si (KR)

(72) Inventors: Yong Geun Kim, Suwon-si (KR); Sang Young Lee, Jeonju-si (KR); Ki Chul An, Daegu-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 0 days.

(21) Appl. No.: 14/770,153

(22) PCT Filed: Feb. 27, 2014

(86) PCT No.: PCT/KR2014/001617

§ 371 (c)(1),
(2) Date: Aug. 25, 2015

(87) PCT Pub. No.: WO2014/133335

PCT Pub. Date: Sep. 4, 2014

(65) Prior Publication Data

US 2016/0007418 A1 Jan. 7, 2016

(30) Foreign Application Priority Data

Feb. 28, 2013 (KR) ..... 10-2013-0021908

(51) Int. Cl.
*H05B 33/08* (2006.01)

(52) U.S. Cl.
CPC ..... *H05B 33/0815* (2013.01); *H05B 33/0824* (2013.01); *H05B 33/0851* (2013.01)

(58) Field of Classification Search
CPC ..... H05B 33/083; H05B 33/0833; H05B 33/0815; H05B 33/0851; H05B 37/02; H05B 41/28; H05B 33/0818; H05B 33/0884
USPC ..... 315/122, 128, 224, 291, 192, 185 R, 315/307, 312, 360
See application file for complete search history.

(56) References Cited

U.S. PATENT DOCUMENTS 8,384,311 B2 2/2013 Gray et al.
8,598,796 B2 * 12/2013 Jeong ..... H05B 33/083 315/185 R (Continued)

FOREIGN PATENT DOCUMENTS

KR 20-0400036 11/2005
KR 10-2011-0016372 2/2011

(Continued)

OTHER PUBLICATIONS

International Search Report for International Application No. PCT/KR2014/001617, dated Jun. 24, 2014.
Written Opinion with English translation for International Application No. PCT/KR2014/001617, dated Jun. 24, 2014.

*Primary Examiner* — Haissa Philogene
(74) *Attorney, Agent, or Firm* — Kile Park Reed & Houtteman PLLC

(57) ABSTRACT

A control circuit of an LED lighting apparatus divided into a plurality of LED channels may include: a current control circuit configured to provide a current path corresponding to sequential light emissions of the LED channels in response to a rectified voltage; and a residual voltage buffer circuit configured to correspond to an LED channel which finally emits light, and buffer a residual voltage when the rectified voltage rises to a preset value such that the residual voltage occurs.

11 Claims, 2 Drawing Sheets

(56) References Cited

U.S. PATENT DOCUMENTS

| | | | | |
|---|---|---|---|---|
| 8,704,446 | B2 | 4/2014 | Gibbs | |
| 8,736,178 | B2 * | 5/2014 | Lee | H05B 33/083 315/122 |
| 2010/0013411 | A1 | 1/2010 | Krespach et al. | |
| 2011/0199003 | A1 | 8/2011 | Muguruma et al. | |
| 2012/0146514 | A1 | 6/2012 | Jeong | |
| 2013/0200802 | A1 | 8/2013 | Sakuragi et al. | |
| 2015/0008836 | A1 | 1/2015 | Kim | |

FOREIGN PATENT DOCUMENTS

| | | |
|---|---|---|
| KR | 10-1043533 | 6/2011 |
| KR | 10-1160154 | 6/2012 |
| KR | 10-1175934 | 8/2012 |
| WO | 2012/078182 | 6/2012 |

* cited by examiner

CONTROL CIRCUIT OF LED LIGHTING APPARATUS

BACKGROUND

1. Technical Field

The present disclosure relates to an LED lighting apparatus, and more particularly, to a control circuit of an LED lighting apparatus, which has a voltage buffer function.

2. Related Art

According to the recent trend of lighting technology, LEDs have been employed as a light source in order to reduce energy.

A high-brightness LED is differentiated from other light sources in terms of various aspects such as energy consumption, lifetime, and light quality.

However, a lighting apparatus using LEDs as a light source may require additional circuits due to the characteristic of the LEDs which are driven by a constant current.

Examples of lighting apparatuses which have been developed to solve the above-described problem may include an AC direct-type lighting apparatus.

In general, the AC direct-type LED lighting apparatus is designed to drive an LED using a rectified voltage obtained by rectifying commercial power.

Since the above-described AC direct-type LED lighting apparatus directly uses the rectified voltage as an input voltage without using an inductor and a capacitor, the AC direct-type LED lighting apparatus has a satisfactory power factor.

Each LED of the LED lighting apparatus may be designed to operate at 2.8V or 3.8V, for example. Depending on cases, the LED lighting apparatus may be designed in such a manner that a large number of LEDs connected in series emit light using a rectified voltage.

The LED lighting apparatus may be configured in such a manner that the LEDs are sequentially turned on/off at each channel according to the increase/decrease of the rectified voltage.

The LED lighting apparatus may be driven in various environments. In particular, the LED lighting apparatus may be driven by a higher voltage than a design value, due to an unstable power characteristic or power system environment of the region where the LED lighting apparatus is used.

That is, the LED lighting apparatus may be driven in a state where an over voltage equal to or more than a voltage required for operating LEDs is applied. In this case, an over current may be generated by the over voltage in a state where all of the LEDs emit light.

The over current may have an influence on a current control circuit of the LED lighting apparatus. In a severe case, parts of the current control circuit may be damaged by a malfunction or thermal stress. In particular, an integrated circuit chip including the current control circuit may be damaged.

Recently, the demand for high-capacity LED lighting apparatuses has been increasing. In the case of a high-capacity LED lighting apparatus, the influence of the over voltage may be intensified. Furthermore, the lifetime of the LED lighting apparatus may be reduced, or the reliability of the LED lighting apparatus may be degraded due to a malfunction and part damage.

SUMMARY

Various embodiments are directed to a control circuit of an LED lighting apparatus, which is capable of guaranteeing a stable current flow of a current control circuit for controlling light emission of LEDs even though a higher voltage than a design value is applied due to a power system environment or unstable power characteristic.

Also, various embodiments are directed to a control circuit of an LED lighting apparatus, which is capable of buffering a residual voltage contained in a rectified voltage even though a higher voltage than a design value is applied due to a power system environment or unstable power characteristic.

Also, various embodiments are directed to a control circuit of an LED lighting apparatus, which is capable of absorbing a residual voltage which is equal to or more than a preset value and contained in a rectified voltage, even though a higher voltage than a design value is applied due to a power system environment or unstable power characteristic, thereby preventing heat generation by the residual voltage in an integrated circuit chip.

In an embodiment, a control circuit of an LED lighting apparatus divided into a plurality of LED channels may include: a current control circuit configured to provide a current path corresponding to sequential light emissions of the LED channels in response to a rectified voltage; and a residual voltage buffer circuit configured to correspond to an LED channel which finally emits light, and buffer a residual voltage when the rectified voltage rises to a preset value such that the residual voltage occurs.

DETAILED DESCRIPTION

Figure 1:
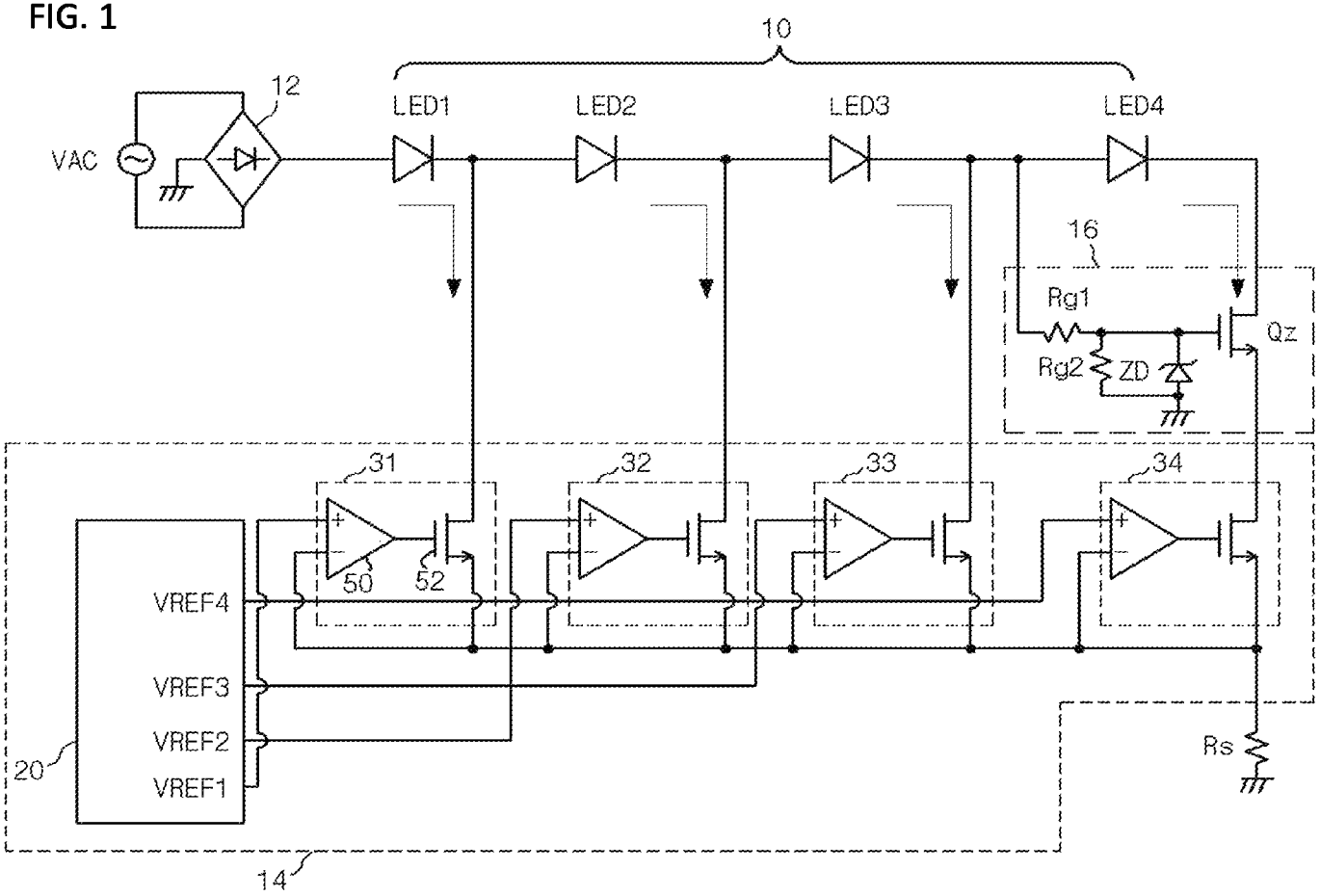
FIG. 1 is a circuit diagram illustrating a control circuit of an LED lighting apparatus in accordance with an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

The embodiments of the present invention disclose a circuit which guarantees a stable current flow of a current control circuit even though an LED lighting apparatus is driven by a higher voltage than a design value due to the power system environment or unstable power characteristic.

An embodiment of FIG. 1 may emit light using a rectified voltage, and perform current regulation for light emission.

Referring to FIG. 1, the embodiment of the present invention may include a lamp 10, a power supply unit, a current control circuit 14, and a residual voltage buffer circuit 16. The power supply unit may provide a rectified voltage obtained by converting commercial power to the lamp 10, and the current control circuit 14 may provide a current path for light emission to each LED channel of the lamp 10.

The lamp 10 may include LEDs divided into a plurality of LED channels. The LEDs included in the lamp 10 may be sequentially turned on/off for each LED channel by the increase/decrease of the rectified voltage provided from the power supply unit.

FIG. 1 illustrates that the lamp 10 includes four LED channels LED1 to LED4. Each of the LED channels LED1 to LED4 may include one or more LEDs. For convenience of description, one or more LEDs may be represented by one reference numeral.

The power supply unit may be configured to rectify an AC voltage introduced from outside and output the rectified voltage.

The power supply unit may include an AC power source VAC having an AC voltage and a rectifier circuit 12 configured to rectify an AC voltage and output the rectified voltage.

The AC power source VAC may include a commercial power source.

Figure 2:
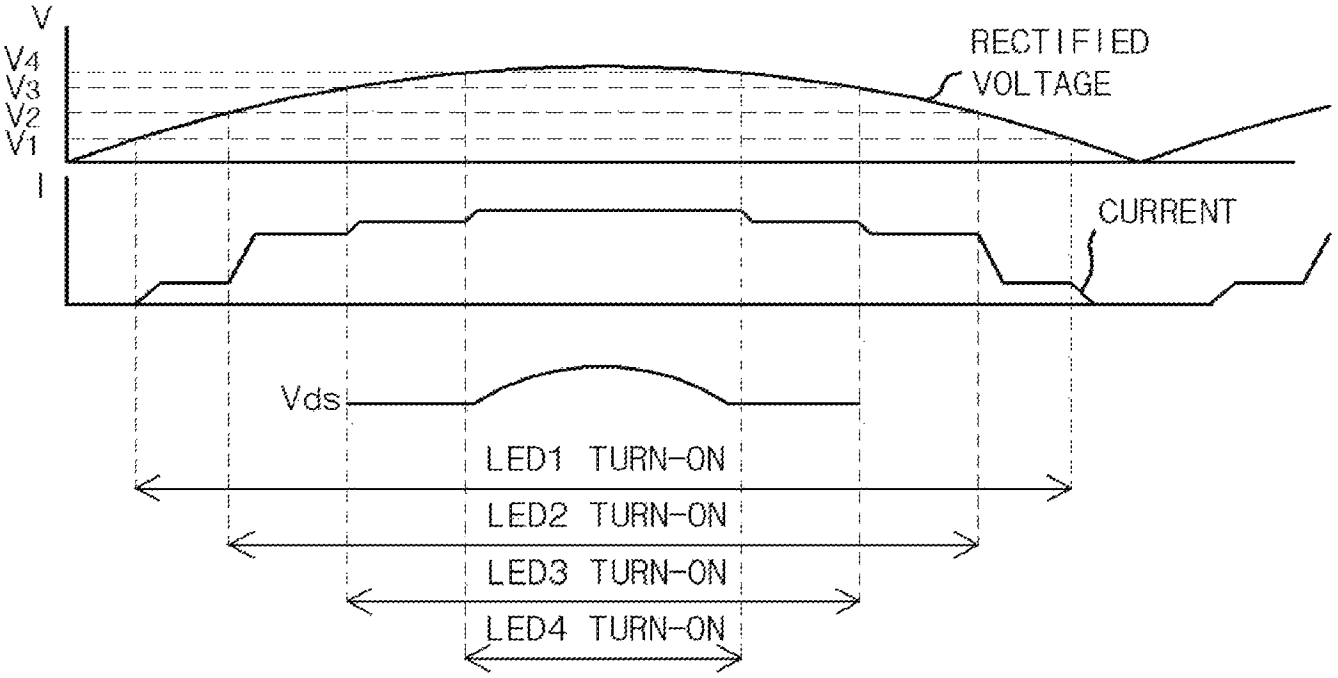
FIG. 2 is a waveform diagram for describing the operation of the embodiment of FIG. 1.

The rectifier circuit 12 may full-wave rectify a sine-wave AC voltage of the AC power source VAC, and output the rectified voltage. As illustrated in FIG. 2, the rectified voltage may have a ripple of which the voltage level rises/falls at each half cycle of the commercial AC voltage. In the embodiment of the present invention, the rise or fall of the rectified voltage may indicate a rise or fall of the ripple of the rectified voltage.

The current control circuit 14 may perform current regulation for light emission of the LED channels LED1 to LED4.

The current control circuit 14 may be configured to provide a current path for current regulation through a sensing resistor Rs of which one end is grounded.

According to the embodiment of the present invention, the LED channels LED1 to LED4 of the lamp 10 may be sequentially turned on/off in response to a rise/fall of the rectified voltage.

When the rectified voltage rises to sequentially reach the light emitting voltages of the respective LED channels LED1 to LED4, the current control circuit 14 may provide a current path for light emission to the respective LED channels LED1 to LED4.

The light emitting voltage V4 at which the LED channel LED4 emits light may be defined as the voltage at which all of the LED channels LED1 to LED4 emit light. The light emitting voltage V3 at which the LED channel LED3 emits light may be defined as the voltage at which the LED channels LED1 to LED3 emit light. The light emitting voltage V2 at which the LED channel LED2 emits light may be defined as the voltage at which the LED channels LED1 and LED2 emit light. The light emitting voltage V1 at which the LED channel LED1 emits light may be defined as the voltage at which only the LED channel LED1 emits light.

The current control circuit 14 may receive a sensing voltage through the sensing resistor Rs. The sensing voltage may be varied by a current path which is differently formed depending on a light emitting state of each LED channel in the lamp 10. At this time, a constant current as a current for each channel may flow through the sensing resistor Rs.

The current control circuit 14 may include a plurality of switching circuits 31 to 34 and a reference voltage supply unit 20. The plurality of switching circuits 31 to 34 may be configured to provide a current path for the LED channels LED1 to LED4, and the reference voltage supply unit 20 may be configured to provide reference voltages VREF1 to VREF4.

The reference voltage supply unit 20 may be configured to provide the reference voltages VREF1 to VREF4 having different levels according to a producer's intention.

The reference voltage supply unit 20 may include a plurality of resistors which are connected in series so as to receive a constant voltage, and output the reference voltages VREF1 to VREF4 having different levels through the respective nodes between the resistors. In another embodiment, the reference voltage supply unit 20 may include independent voltage supply sources for providing the reference voltages VREF1 to VREF4 having different levels.

Among the reference voltages VREF1 to VREF4 having different levels, the reference voltage VREF1 may have the lowest voltage level, and the reference voltage VREF4 may have the highest voltage level. The voltage level may gradually increase in order of the reference voltages VREF1 to VREF4.

The reference voltage VREF1 may have a level for turning off the switching circuit 31 at the time point where the LED channel LED2 emits light. More specifically, the reference voltage VREF1 may be set to a lower level than the sensing voltage which is formed in the sensing resistor Rs by the light emitting voltage V2 of the LED channel LED2.

The reference voltage VREF2 may have a level for turning off the switching circuit 32 at the time point where the LED channel LED3 emits light. More specifically, the reference voltage VREF2 may be set to a lower level than the sensing voltage which is formed in the sensing resistor Rs by the light emitting voltage V3 of the LED channel LED3.

The reference voltage VREF3 may have a level for turning off the switching circuit 33 at the time point where the LED channel LED4 emits light. More specifically, the reference voltage VREF3 may be set to a lower level than the sensing voltage which is formed in the sensing resistor Rs by the light emitting voltage V4 of the LED channel LED4.

The reference voltage VREF4 may be set in such a manner that the current formed in the sensing resistor Rs becomes a constant current in the upper limit level region of the rectified voltage.

The switching circuits 31 to 34 may be commonly connected to the current sensing resistor Rs which provides a sensing voltage, in order to perform current regulation and form a current path.

The switching circuits 31 to 34 may compare the sensing voltage of the sensing resistor Rs to the reference voltages VREF1 to VREF4 of the reference voltage supply unit 20, and form a selective current path for turning on the lamp 10.

Each of the switching circuits 31 to 34 may receive a high-level reference voltage as the switching circuit is connected to an LED channel remote from the position to which the rectified voltage is applied.

Each of the switching circuits 31 to 34 may include a comparator 50 and a switching element, and the switching element may include an NMOS transistor 52.

The comparator 50 included in each of the switching circuits 31 to 34 may have a positive input terminal (+) configured to receive a reference voltage, a negative input terminal (−) configured to receive a sensing voltage, and an output terminal configured to output a result obtained by comparing the reference voltage and the sensing voltage.

The NMOS transistor 52 included in each of the switching circuits 31 to 34 may perform a switching operation according to an output of the comparator 50, which is applied to the gate thereof.

The residual voltage buffer circuit 16 may be provided outside an integrated circuit chip including the current control circuit 14, and configured in series on the current path of the LED channel LED4 which finally emits light.

According to the above-described configuration, the residual voltage buffer circuit 16 may restrict a current flowing from the LED channel LED4 to the current control circuit 14 in response to a residual voltage contained in a rectified voltage, when an over voltage is applied.

That is, the residual voltage buffer circuit 16 may be configured in series on the current path of the LED channel LED4, and control a flow of over current into the current control circuit 14 by performing voltage buffering in response to a residual voltage in an over-voltage state. The residual voltage buffer circuit 16 may perform voltage buffering through voltage absorption.

The residual voltage buffer circuit 16 may be configured in series on the current path of the LED channel LED4, and perform voltage buffering by absorbing a residual voltage which is equal to or more than a preset value and contained in a rectified voltage in an over-voltage state and.

The residual voltage buffer circuit 16 may include a detection unit and a switching unit. The detection unit may provide a detection voltage corresponding to a rise of the residual voltage, and the switching unit may perform current control between the current control circuit 14 and the LED channel LED4 which finally emits light, according to the detection voltage.

The switching unit included in the residual voltage buffer circuit 16 may include a power FET (hereafter, referred to as transistor Qz) for controlling a current flow according to the detection voltage.

The detection unit may include a detection resistor Rg1, a voltage division resistor Rg2, and a Zener diode ZD. The detection resistor Rg1 may be connected in parallel to the LED channel LED4, and the voltage division resistor Rg2 and the Zener diode ZD may be connected in parallel to the detection resistor Rg1. The voltage division resistor Rg2 may divide a voltage applied to the detection resistor Rg1 and apply the divided voltage to the gate of the switching unit of the residual voltage buffer circuit 16. The Zener diode ZD may uniformize the voltage applied to the gate of the switching unit of the residual voltage buffer circuit 16 by suppressing the voltage to a predetermined value, and restrict the current flowing through the LED to a constant current, thereby absorbing the residual voltage.

The Zener diode ZD may be configured to have a breakdown voltage of 3V to 50V, corresponding to the current constant.

In the residual voltage buffer circuit 16 having the above-described configuration, the Zener diode ZD may serve as a constant voltage source in response to a normal rectified voltage. Thus, the residual voltage buffer circuit 16 may absorb a residual voltage between the LED channel LED4 and the NMOS transistor 52 of the switching circuit 34 of the current control circuit 14 through the turned-on transistor Qz, thereby guaranteeing normal voltage application and current flow.

First, the operation of the LED lighting apparatus in a state where a normal rectified voltage is applied will be described with reference to FIG. 2.

When a rectified voltage is in the initial state, the switching circuits 31 to 34 may maintain a turn-on state because the reference voltages VREF1 to VREF4 applied to the positive input terminals (+) thereof are higher than the sensing voltage of the sensing resistor Rs, which is applied to the negative input terminals (−) thereof.

Then, when the rectified voltage rises to reach the light emitting voltage V1, the LED channel LED1 of the lamp 10 may emit light. Then, when the LED channel LED1 of the lamp 10 emits light, the switching circuit 31 of the current control circuit 14, connected to the LED channel LED1, may provide a current path.

When the rectified voltage reaches the light emitting voltage V1 such that the LED channel LED1 emits light and the current path is formed through the switching circuit 31, the level of the sensing voltage of the sensing resistor Rs may rise. However, since the level of the sensing voltage is low, the turn-on states of the switching circuits 31 to 34 may not be changed.

Then, when the rectified voltage continuously rises to reach the light emitting voltage V2, the LED channel LED2 of the lamp 10 may emit light. When the LED channel LED2 of the lamp 10 emits light, the switching circuit 32 of the current control circuit 14, connected to the LED channel LED2, may provide a current path. At this time, the LED channel LED1 may maintain a light emitting state.

When the rectified voltage reaches the light emitting voltage V2 such that the LED channel LED2 emits light and the current path is formed through the switching circuit 32, the level of the sensing voltage of the sensing resistor Rs may rise. At this time, the sensing voltage may have a higher level than the reference voltage VREF1. Therefore, the NMOS transistor 52 of the switching circuit 31 may be turned off by an output of the comparator 50. That is, the switching circuit 31 may be turned off, and the switching circuit 32 may provide a selective current path corresponding to the light emission of the LED channel LED2.

Then, when the rectified voltage continuously rises to reach a light emitting voltage V3, the LED channel LED3 of the lamp 10 may emit light. Then, when the LED channel LED3 of the lamp 10 emits light, the switching circuit 33 of the current control circuit 14, connected to the LED channel LED3, may provide a current path. At this time, the LED channels LED1 and LED2 may also maintain a light emitting state.

When the rectified voltage reaches the light emitting voltage V3 such that the LED channel LED3 emits light and the current path is formed through the switching circuit 33, the level of the sensing voltage of the sensing resistor Rs may rise. At this time, the sensing voltage may have a higher level than the reference voltage VREF2. Therefore, the NMOS transistor 52 of the switching circuit 32 may be turned off by the output of the comparator 50. That is, the switching circuit 32 may be turned off, and the switching circuit 33 may provide a selective current path corresponding to the light emission of the LED channel LED3.

Then, when the rectified voltage continuously rises to reach the light emitting voltage V4, the LED channel LED4 of the lamp 10 may emit light. When the LED channel LED4 of the lamp 10 emits light, the switching circuit 34 of the current control circuit 14, connected to the LED channel LED4, may provide a current path. At this time, the LED channels LED1 to LED3 may also maintain a light emitting state.

When the rectified voltage reaches the light emitting voltage V4 such that the LED channel LED4 emits light and the current path is formed through the switching circuit 34, the level of the sensing voltage of the sensing resistor Rs may rise. At this time, the sensing voltage may have a higher level than the reference voltage VREF3. Therefore, the NMOS transistor 52 of the switching circuit 33 may be turned off by the output of the comparator 50. That is, the switching circuit 33 may be turned off, and the switching circuit 34 may provide a selective current path corresponding to the light emission of the LED channel LED4.

Then, although the rectified voltage continuously rises, the switching circuit 34 may maintain the turn-on state such that the current formed in the sensing resistor Rs becomes a constant current in the upper limit level region of the rectified voltage.

When the LED channels LED1 to LED4 sequentially emit light in response to the rises of the rectified voltage, the current of the current path, corresponding to the light emitting state, may increase in a stepwise manner as illustrated in FIG. 2. That is, since the current control circuit 14 performs constant current regulation, the current corresponding to light emission of each LED channel may maintain a constant level. When the number of LED channels emitting light increases, the level of the current on the current path may rise in response to the increase.

After the rectified voltage rises to the upper limit level as described above, the rectified voltage may start to fall.

When the rectified voltage falls below the light emitting voltage V4, the LED channel LED4 of the lamp 10 may be turned off.

When the LED channel LED4 is turned off, the lamp 10 may maintain the light emitting state using the LEDs LED3, LED2, and LED1. Thus, a current path may be formed by the switching circuit 33 connected to the LED channel LED3.

Then, when the rectified voltage sequentially falls below the light emitting voltage V3, the light emitting voltage V2, and the light emitting voltage V1, the LED channels LED3, LED2, and LED1 of the lamp 10 may be sequentially turned off.

As the LED channels LED3, LED2, and LED1 of the lamp 10 are sequentially turned off, the current control circuit 14 may shift and provide a selective current path formed by the switching circuits 33, 32, and 31. Furthermore, the level of the current on the current path may also fall in a stepwise manner, in response to the turn-off states of the LED channels LED1 to LED4.

In the above-described embodiment, the LED lighting apparatus may be driven by a higher voltage (hereafter, referred to as over voltage) than a design value, due to a power system environment or unstable power characteristic.

That is, the embodiment of the present invention may be driven by the over voltage, and a rectified voltage in an over-voltage state may include a residual voltage equal to or more than a preset value.

In the embodiment of the present invention, suppose that the maximum value of a ripple of the rectified voltage is designed to 220V. In this case, the maximum value of the waveform of the rectified voltage in the over-voltage state may rise over 250V.

Thus, when the rectified voltage driven in the over-voltage state gradually rises, the LED channels LED1 to LED4 may sequentially emit light according to the level of the rectified voltage.

Even when the LED channel LED4 finally emits light, the rectified voltage in the over-voltage state may rise over the design value at which the LED channel LED4 is driven, that is, 220V.

The voltage applied to the LED channel LED4 may be detected and divided by the detection resistor Rg1 and the voltage division resistor Rg2, and transmitted as a reverse bias voltage of the Zener diode ZD.

The Zener diode ZD may have a breakdown voltage set in the range of 3V to 50V, and serve as a constant voltage source until the voltage transmitted through the detection resistor Rg1 and the voltage division resistor Rg2 reaches the breakdown voltage, thereby guaranteeing a normal turn-on state of the transistor Qz.

When the rectified voltage applied to the LED channel LED4 enters an over-voltage state such that the voltage transmitted to the Zener diode ZD exceeds the breakdown voltage, the Zener diode ZD may reduce the detection voltage in response to a residual voltage equal to or more than a design value, such that the gate voltage of the transistor Qz does not increase any more. That is, as the limited detection voltage of the Zener diode ZD is applied to the gate of the transistor Qz despite the increase of the residual voltage, the drain-source voltage may be increased to induce a drop of the residual voltage.

More specifically, when the voltage limited by the Zener diode ZD is applied to the gate of the transistor Qz, the current of the transistor Qz may not be increased any more, but constantly maintained. Thus, as a voltage corresponding to the residual voltage Vds of FIG. 2 is applied between the source and drain of the transistor Qz, the transistor Qz may absorb the residual voltage Vds. As the residual voltage Vds is absorbed between the source and drain of the transistor Qz, it is possible to an over voltage from being applied to the switching element of the integrated circuit chip which forms a current path for the LED channel LED4 which finally emits light in the current control circuit 14.

When the rectified voltage applied to the LED channel LED4 which finally emits light rises to an over voltage equal to or more than a preset value, the residual voltage buffer circuit 16 may buffer the residual voltage, thereby guaranteeing a normal operation of the current control circuit 14.

Thus, the residual voltage caused by the rectified voltage in the over-voltage state may be prevented from being applied to the integrated circuit chip including the current control circuit 14. The residual voltage included in the rectified voltage in the over-voltage state may be absorbed and buffered outside the integrated circuit chip.

In consideration of heat generated by the residual voltage, the transistor Qz may be implemented with a power FET (Field Effect Transistor) capable of performing a stable operation for the heat generation.

As described above, the embodiment of the present invention may perform voltage buffering in response to residual power, even though the LED lighting apparatus is driven by an over voltage higher than a design value due to a power system environment or unstable power characteristic, thereby preventing heat generation in the current control circuit.

Therefore, the embodiment of the present invention can prevent the damage of parts due to a malfunction or thermal stress of the control circuit of the LED lighting apparatus, which is caused by an over voltage. As a result, the lifetime and reliability of products can be improved.

In particular, when the LED lighting apparatus is designed to have a large capacity, the embodiment of the present invention can effectively solve the heating problem caused by a higher voltage than the design value.

In accordance with the embodiments of the present invention, although the LED lighting apparatus is driven by a higher voltage than a design value due to a power system environment or unstable power characteristic, the control circuit can guarantee a stable current flow of the current control circuit, thereby preventing the damage of parts which may occur due to a malfunction or thermal stress caused by a residual voltage.

Furthermore, although the LED lighting apparatus is driven by a higher voltage than a design value due to a power system environment or unstable power characteristic, the control circuit may perform voltage buffering corresponding to an over voltage outside the integrated circuit chip, thereby preventing the heat generation of the integrated circuit chip due to a residual voltage.

Furthermore, although the LED lighting apparatus is driven by a higher voltage than a design value due to a power system environment or unstable power characteristic, the control circuit may absorb a residual voltage which is equal to or more than and contained in a rectified voltage, outside the integrated circuit chip, thereby guaranteeing a stable operation of the current control circuit. Thus, the control circuit can prevent the degradation in reliability of products due to a malfunction or thermal stress.

Furthermore, when the LED lighting apparatus is designed to have a large capacity, the control circuit can solve a heating problem which may occur when the LED lighting apparatus is driven by a higher voltage than a design value.

While various embodiments have been described above, it will be understood to those skilled in the art that the embodiments described are by way of example only. Accordingly, the disclosure described herein should not be limited based on the described embodiments.

What is claimed is:

1. A control circuit of an LED lighting apparatus divided into a plurality of LED channels, comprising:

a current control circuit configured to provide a current path corresponding to sequential light emissions of the LED channels in response to a rectified voltage; and a residual voltage buffer circuit configured to correspond to an LED channel which finally emits light, and buffer a residual voltage when the rectified voltage rises to a preset value such that the residual voltage occurs, wherein the residual voltage buffer circuit comprises:

a residual voltage detection unit configured to provide a detection voltage corresponding to an increase of the residual voltage; and a switching unit configured to buffer the residual voltage according to the detection voltage.

2. The control circuit of claim 1, wherein the current control circuit is connected to a sensing resistor which provides a sensing voltage corresponding to a current flow of the current path, and provides the current path in response to the sensing voltage and a change in light emitting states of the LED channels.

3. The control circuit of claim 1, wherein the current control circuit performs constant current regulation in response to the sequential light emissions of the LED channels.

4. The control circuit of claim 1, wherein the current control circuit provides reference voltages having different levels in response to light emitting states of the LED channels, compares a sensing voltage corresponding to a current on the current path to the reference voltages, and provides the current path corresponding to a change in the light emitting states of the LED channels.

5. The control circuit of claim 1, wherein the residual voltage buffer circuit is configured outside an integrated circuit chip including the current control circuit.

6. The control circuit of claim 1, wherein the residual voltage buffer circuit absorbs the residual voltage applied to the current path of the LED channel which finally emits light, in response to the residual voltage.

7. The control circuit of claim 1, wherein the residual voltage detection unit comprises:

a detection resistor connected in parallel to the LED channel which finally emits light; and the Zener diode configured to receive a voltage of the detection resistor and provide the detection voltage in response to the increase of the residual voltage.

8. The control circuit of claim 1, wherein the residual voltage detection unit comprises a Zener diode.

9. The control circuit of claim 8, wherein the Zener diode has a breakdown voltage of 3V to 50V.

10. The control circuit of claim 1, wherein the switching unit comprises a power FET (Field Effect Transistor) which absorbs the residual voltage according to the detection voltage.

11. The control circuit of claim 10, wherein the residual voltage detection unit increases a drain-source voltage of the power FET and induces a drop of the residual voltage.

* * * * *